US011412871B2

(12) United States Patent
Frohn

(10) Patent No.: US 11,412,871 B2
(45) Date of Patent: Aug. 16, 2022

(54) SYSTEM AND METHOD FOR COVERING AND LIGHTING A TABLE

(71) Applicant: Joanna Lange Frohn, Altadena, CA (US)

(72) Inventor: Joanna Lange Frohn, Altadena, CA (US)

( * ) Notice: Subject to any disclaimer, the term of this patent is extended or adjusted under 35 U.S.C. 154(b) by 0 days.

(21) Appl. No.: 17/248,389

(22) Filed: Jan. 22, 2021

(65) Prior Publication Data

US 2021/0228005 A1 Jul. 29, 2021

Related U.S. Application Data

(60) Provisional application No. 62/964,714, filed on Jan. 23, 2020.

(51) Int. Cl.
*A47G 11/00* (2006.01)
*A47B 97/00* (2006.01)

(52) U.S. Cl.
CPC ..... *A47G 11/004* (2013.01); *A47B 97/00* (2013.01); *A47G 11/006* (2013.01); *A47B 2220/0077* (2013.01)

(58) Field of Classification Search
CPC .. A47G 11/004; A47G 11/003; A47G 11/006; A47G 11/008; A47G 2011/005; A47B 97/00; A47B 2220/0077
See application file for complete search history.

(56) References Cited

U.S. PATENT DOCUMENTS 2,586,153 A * 2/1952 Eisman ..... A63F 1/06 108/90
2,727,253 A * 12/1955 Guytomsic ..... A47C 31/105 5/496
4,328,271 A * 5/1982 Rountree ..... A47G 11/003 156/70
4,705,084 A * 11/1987 Rodebaugh ..... A47C 31/10 108/90
4,708,183 A 11/1987 Figueroa
4,789,019 A 12/1988 Sweetser et al.
5,084,321 A 1/1992 Sui
5,339,748 A 8/1994 Bilotti
5,358,155 A * 10/1994 Ciesla ..... A47G 11/003 108/90
5,582,115 A * 12/1996 Muller ..... A47C 7/66 108/90
5,778,802 A 7/1998 Hairston et al.
6,381,812 B1 5/2002 Crider et al.
(Continued)

FOREIGN PATENT DOCUMENTS

JP 3205334 U * 7/2016

*Primary Examiner* — Hanh V Tran
(74) *Attorney, Agent, or Firm* — Dunlap Bennett & Ludwig, PLLC

(57) ABSTRACT

A table system includes a tablecloth, a table, and a table kit. The tablecloth defines an upper surface and a lower surface. The table includes a tabletop, at least one leg, and a table base. The table kit comprises various components, including a plurality of tabs and a drawstring. Each tab defines a conduit, and each tab is connected to the lower surface of the tablecloth. The drawstring extends through each of the plurality of tabs. In use, the plurality of tabs are gathered towards the at least one leg by tension applied to the drawstring, and ends of the drawstring are tied together to secure the tablecloth to the table.

9 Claims, 4 Drawing Sheets

(56) References Cited

U.S. PATENT DOCUMENTS 7,044,067 B2 5/2006 Saccomandi
D548,506 S * 8/2007 Morrow ..... D6/617
10,292,510 B1 * 5/2019 Tefft-Feldman ... A47G 23/0303
10,321,777 B2 6/2019 Simmons-Ellis
10,448,766 B2 10/2019 Bass et al.
10,506,873 B1 * 12/2019 Hung ..... A47F 10/06
D891,818 S * 8/2020 Hardjadinata ..... D6/617
2002/0043186 A1 * 4/2002 Kelldorf ..... A47G 11/004 108/93
2002/0062766 A1 * 5/2002 Badaracco ..... A47G 11/003 108/90
2002/0174809 A1 * 11/2002 Kerrigan ..... A47G 11/003 108/90
2003/0015270 A1 1/2003 McClenahan et al.
2003/0031826 A1 * 2/2003 Cleveland ..... A47G 11/004 428/99
2004/0040478 A1 3/2004 Skertchly
2004/0194673 A1 * 10/2004 Comeaux ..... A61B 50/10 108/90
2005/0013967 A1 * 1/2005 Saccomandi ..... A47G 11/003 428/99
2005/0158510 A1 * 7/2005 Trump ..... A47F 7/146 428/102
2005/0274298 A1 * 12/2005 Paulin ..... A47B 13/083 108/90
2008/0257231 A1 * 10/2008 Nurse-Bey ..... A47G 11/004 108/90
2010/0102015 A1 * 4/2010 Benneche ..... A47B 97/00 211/183
2010/0224104 A1 * 9/2010 Swistun ..... A47G 11/004 108/90
2011/0100269 A1 5/2011 Hull
2011/0139041 A1 6/2011 Pappas et al.
2012/0284917 A1 * 11/2012 Nirmel ..... A47G 11/003 5/417
2013/0190157 A1 * 7/2013 Gogiberidze ..... A47G 5/00 493/394
2015/0300627 A1 * 10/2015 Wang ..... F21S 9/02 108/23
2017/0347817 A1 12/2017 Dessaint Kimura et al.
2018/0344061 A1 * 12/2018 Simmons-Ellis .... A47G 21/167
2019/0239669 A1 8/2019 Causey et al.
2020/0281379 A1 9/2020 Groves

* cited by examiner

SYSTEM AND METHOD FOR COVERING AND LIGHTING A TABLE

CROSS-REFERENCE TO RELATED APPLICATION

This application claims the benefit of priority of U.S. provisional application No. 62/964,714, filed Jan. 23, 2020, the contents of which are herein incorporated by reference.

BACKGROUND OF THE INVENTION

The present invention relates to, among other things, tablecloths that securely fasten around tables for windy days.

There are many issues with tables in the hospitality/special event industry. Tablecloths blow off or slide to one side of the tables when it's windy. When this occurs, the wind reveals the unsightly legs of rental tables. Weights are used mostly by do-it-yourself individuals and they are time consuming and must be removed before laundering. No one makes them because they would be difficult to launder, iron, and would increase shipping costs. Even when the tablecloth doesn't blow off, other problems exist, such as the unsightly legs of the table still being visible and inadequate lighting options at the table location.

As can be seen, there is a need for a system that ameliorates the aforementioned problems. Disclosed herein are embodiments that include tabs connectable to tablecloths that may then securely fasten around tables for windy days. Further disclosed are table base/feet covers that hide unsightly table feet from view, in use. Additionally, when having an event with insufficient lighting, such as an outdoor event, there is often a need for lighting that does not require electrical hookups. Embodiments of the present invention introduce a table lighting solution.

SUMMARY OF THE INVENTION

In one aspect of the present invention, a table system comprises: a tablecloth defining an upper surface and a lower surface; a table comprising a tabletop, at least one leg, and a table base; and a table kit comprising: a plurality of tabs, with each tab defining a conduit, and each tab being coupled to the lower surface of the tablecloth; and a drawstring extending through each of the plurality of tabs and having ends, wherein the plurality of tabs are gathered towards the at least one leg by tension applied to the drawstring, and the ends of the drawstring are tied together to secure the tablecloth to the table.

In another aspect of the present invention, a table system comprises: a tablecloth defining an upper surface and a lower surface; a table comprising a tabletop, at least one leg, and a table base; and a table kit comprising: a plurality of tabs, with each tab being coupled to the lower surface of the tablecloth; a base cover that covers at least a portion of the table base; and a plurality of drawstrings, with a first end of each drawstring being coupled to a respective tab and a second end of each drawstring being coupled to the base cover to secure the tablecloth to the tabletop.

These and other features, aspects and advantages of the present invention will become better understood with reference to the following drawings, description and claims.

DETAILED DESCRIPTION OF THE INVENTION

Figure 1:
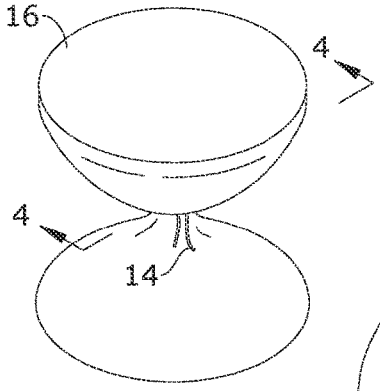
FIG. 1 is a top perspective view of an embodiment of the present invention, showing attachable tubular tabs securing a tablecloth to a table.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention includes a table system comprising a tablecloth defining an upper surface and a lower surface, a table comprising a tabletop, at least one leg, and a table base, and a table kit that comprises various elements that will be described in greater detail in the following disclosure.

Embodiments of the present invention includes a full-length tablecloth designed to stay in place and look unaltered in a windy environment. Tablecloths of the present invention are provided with tabs defining conduits that use a tie/drawstring to keep the tablecloth in place by tying the ends of the drawstring together around one or more table legs from underneath the tablecloth. Depending on the placement of the tabs on the tablecloth, the tablecloth can maintain a traditional silhouette or be changed to a different silhouette, such as an hourglass, and additional décor can be added. Embodiments of the present invention may be provided as assembled with a tablecloth or be provided in the form of a conversion kit for already-made tablecloths. The kit of the present invention allows the user to attach tabs to a tablecloth and insert one or more drawstrings/ties to achieve the same results as with the tablecloths of the present invention initially manufactured with the attachment structure described herein.

In other advantageous aspects of the present invention, the kit may further include multiple means for securing the tablecloth in place, covers specifically designed for table bases, as well as connectable holders for lights. These, and other inventive aspects of the present invention, will be made readily apparent by the following disclosure. While using the tabs previously mentioned, the tablecloth bottom may sway in the wind, revealing the unsightly legs of a table, such as those of a rental table. In this case, and in accordance with the present invention, base covers may be used to camouflage the table legs. The base covers may take various forms, such as a cover that the table base or legs are placed on top of and a tie/drawstring gathers a top portion of the base cover (which may be the same type of fabric/material as the tablecloth) to cover the table leg(s). Similarly, base sleeves may be used to achieve the same end by sliding onto table base legs and securing via a tie or elastic. The tablecloths, base covers and base sleeves can be laundered as any other regular cloth and are easy to use. Consequently, a single individual can easily secure them to a table. Embodiments of the present invention also introduce a table lighting solution that address problems of insufficient lighting at certain events, such as those that occur outdoors.

Figure 2:
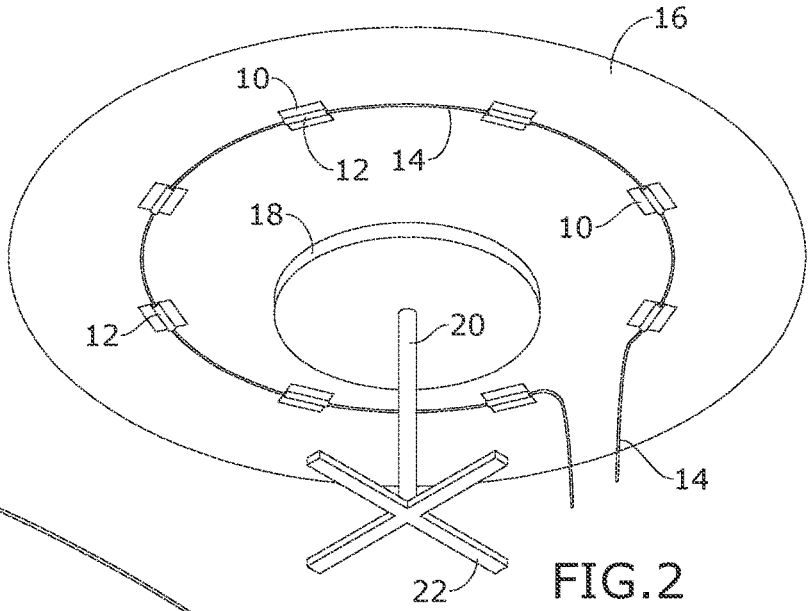
FIG. 2 is a bottom perspective view of the embodiment of the present invention, showing the tubular tabs prior to attachment to the tablecloth.
Figure 3:
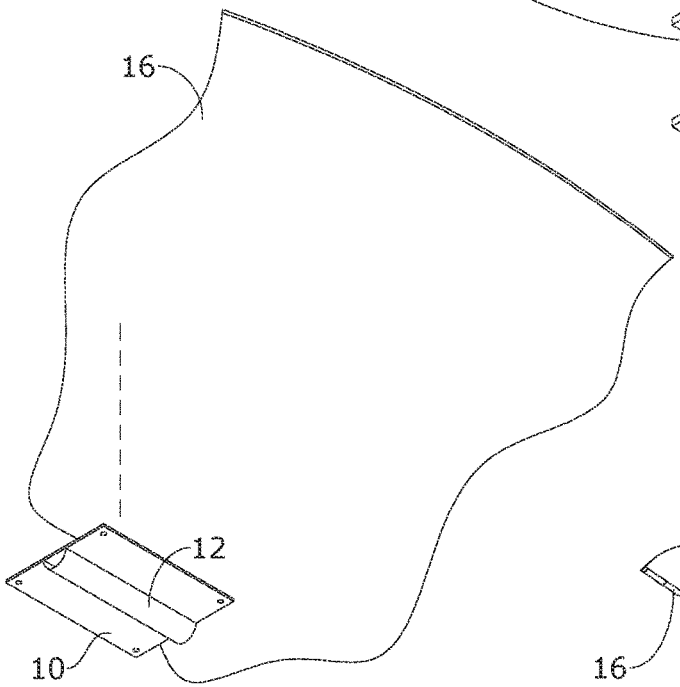
FIG. 3 is a detail exploded view of the embodiment of the present invention, illustrating the attachment of the tubular tabs to the tablecloth.
Figure 4:
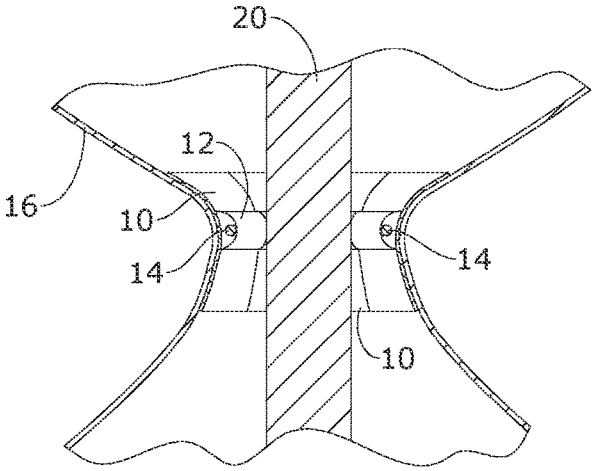
FIG. 4 is a partial section view of the embodiment of the present invention, taken along line 4-4 in FIG. 1.
Figure 5:
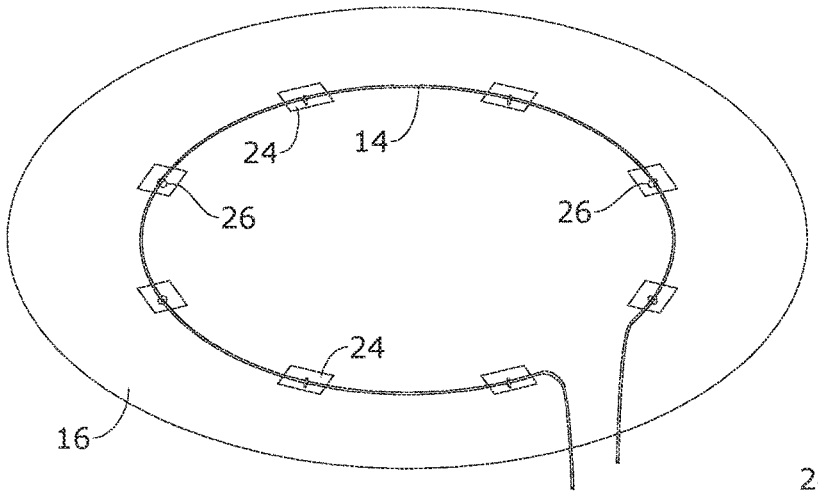
FIG. 5 is a bottom perspective view of the embodiment of the present invention, showing attachable ring tabs secured to a tablecloth in place of the tubular tabs.
Figure 6:
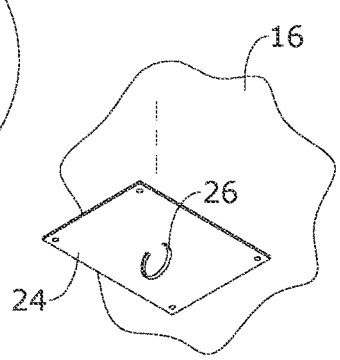
FIG. 6 is a detail exploded view of the embodiment of the present invention, showing the ring labs prior to attachment to the tablecloth.
Figure 7:
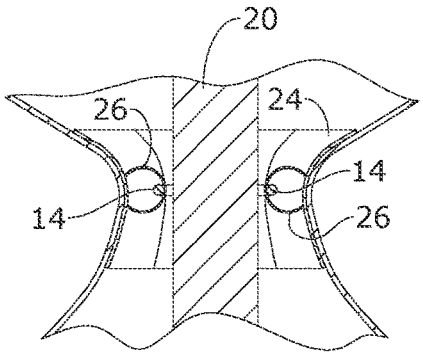
FIG. 7 is a partial section view of the embodiment of the present invention, similar to and taken along the same line as FIG. 4 and illustrating attachment of the ring tabs to the tablecloth.

Referring now to FIG. 1-7, a tablecloth 16 includes a sheet of fabric having an upper surface (see, for example, FIG. 1) and a lower surface (see, for example, FIGS. 2-3), with the tablecloth 16 covering a tabletop 18 and at least a portion of a table post 20, in use. Tubular tabs 10 may be defined on the lower surface of the tablecloth 16, and, in preferred embodiments as part of a kit, may be coupled to the bottom surface of the tablecloth 16. The tubular tabs 10 each include a drawstring sleeve 12 defining a conduit for a drawstring 14. One or more drawstring sleeves 12 defining the conduits may be curved or angled depending on the shape of the tablecloth 16, with a drawstring 14 extending through the conduits, as shown in FIG. 2 and FIG. 4. As shown in FIGS. 5-7, alternatively, a plurality of ring tabs 24 including drawstring rings 26 (that also define a conduit for the drawstring 14) may be used in place or in conjunction with the tubular tabs 10. The overall functionality of the tubular tabs 10 and ring tabs 24 is substantially the same, with the primary difference being the length of the conduit for the drawstring 14 defined. In certain embodiments, a single drawstring 12 may be used, as shown in FIGS. 1-4, and in other (non-illustrated) embodiments, a plurality of drawstrings 12 may be utilized to achieve the same end.

In use, as shown in FIGS. 1, 4 and 7, the lower surface of the tablecloth 16 rests on a top of the tabletop 18, and ends of the drawstring 14 are pulled, which causes the tabs 10, 24 to pulled proximal to one another and collect them and the portions of the tablecloth 16 they are connected to around the table post 20, as shown in FIGS. 4 and 7. The ends of the drawstring are then tied together to secure the drawstring and tabs 10, 24 in place. Thus, with the tabs 10, 24 hidden from view, the tablecloth 16 is securely held in place to the table in an aesthetically pleasing manner.

It will be appreciated by those with skill in the art that any number of tabs 10, 24 may be used in accordance with the present invention, such that the functionality as herein described is achieved and tabs allow the user to more easily thread the drawstring, as opposed to a single conduit. Advantageously, the tabs 10, 24 may be formed from fabric so that they may be laundered, ironed, and lay substantially flat in use (so as not to be noticeable from the top side of the tablecloth 16). Additionally, the placement of the tabs on the tablecloth 16 may be varied to create different visual effects of the tablecloth 16, with FIG. 1 being one such example. The tabs 10, 24 may also be placed on the tablecloth 16 proximal where the tablecloth 16 would drape over the edge of the tabletop 18, resulting in a more natural silhouette of the tablecloth. Finally, it will also be appreciated that the tabs 10, 24 are not necessarily shown to scale and are for illustrative purposes only. Further, the tabs 10, 24 may be included at multiple positions on a single cloth in order to be used on tables of various sizes (e.g., there may be multiple rows/sets of the tabs 10, 24 on a single tablecloth 16). For example, a round cloth that is 108 inches diameter may be secured on a 24-inch diameter round table with a height of 42 inches (e.g., a cocktail table) as well as a 48-inch diameter round table with a height of 30 inches (e.g., a dining table) just by using tabs 10, 24 at various positions. Because of the unique configuration of the tabs 10, 24, they lay substantially flat and thus will not be visible when the tablecloth 16 is set on the tabletop 18.

Figure 8:
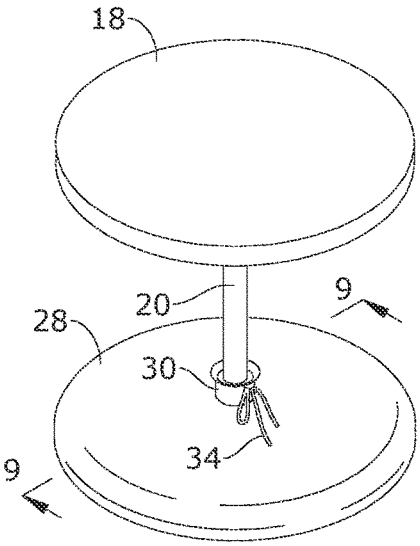
FIG. 8 is a perspective view of the embodiment of the present invention, showing a table base cover attached to a table base.
Figure 9:
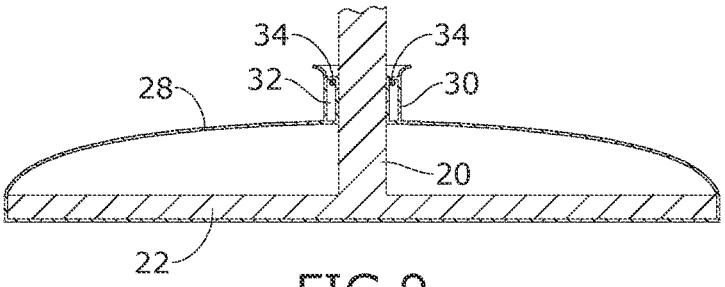
FIG. 9 is a section view of the embodiment of the present invention, taken along line 9-9 in FIG. 8.
Figure 10:
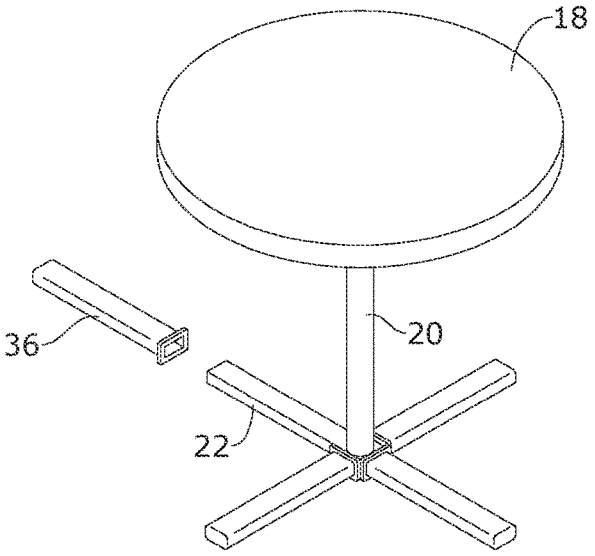
FIG. 10 is a partially exploded view of the embodiment of the present invention, showing a base sleeve prior to being slid onto the table base.

Turning now to FIGS. 8 and 9, a table base 22, which is also typically very unattractive in appearance, may be covered with a base cover 28 of the present invention. In certain embodiments, the base cover 28 may be formed from the same type and color of fabric or material used for the tablecloth 16, such that a consistent visual appearance is achieved. To secure the base cover 28 in place, a base drawstring 34 extends through a conduit 32 of a base cover neck 30. Like operation previously described for securing the tablecloth 16, ends of the base drawstring 34 are pulled tight, drawing the drawstring 34 through the conduit 32 such that the base cover neck material bunches together, and are tied together. As shown in FIG. 10, rather than using the base cover 28 to cover the table base 22, base sleeves 36 (sized and shaped to conform to common table leg/base shapes and sizes) may also be provided as part of the kit and used to cover the table base 22 in an aesthetically pleasing manner.

Figure 11:
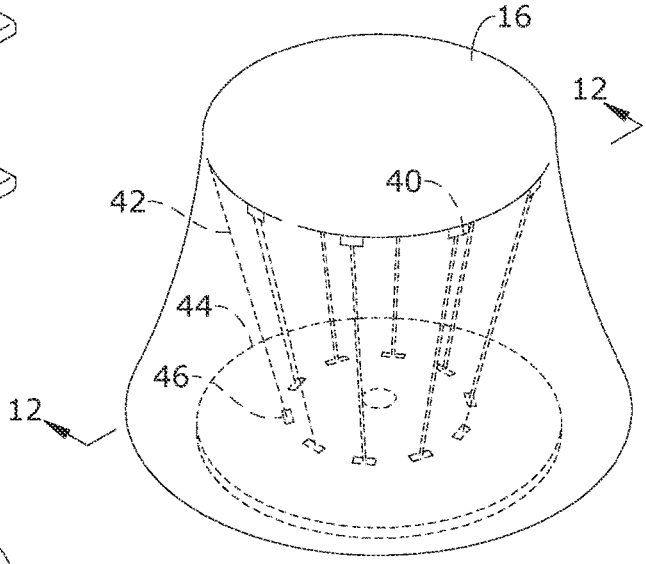
FIG. 11 is a perspective view of the embodiment of the present invention, showing an alternative method for securing the tablecloth to the table.
Figure 12:
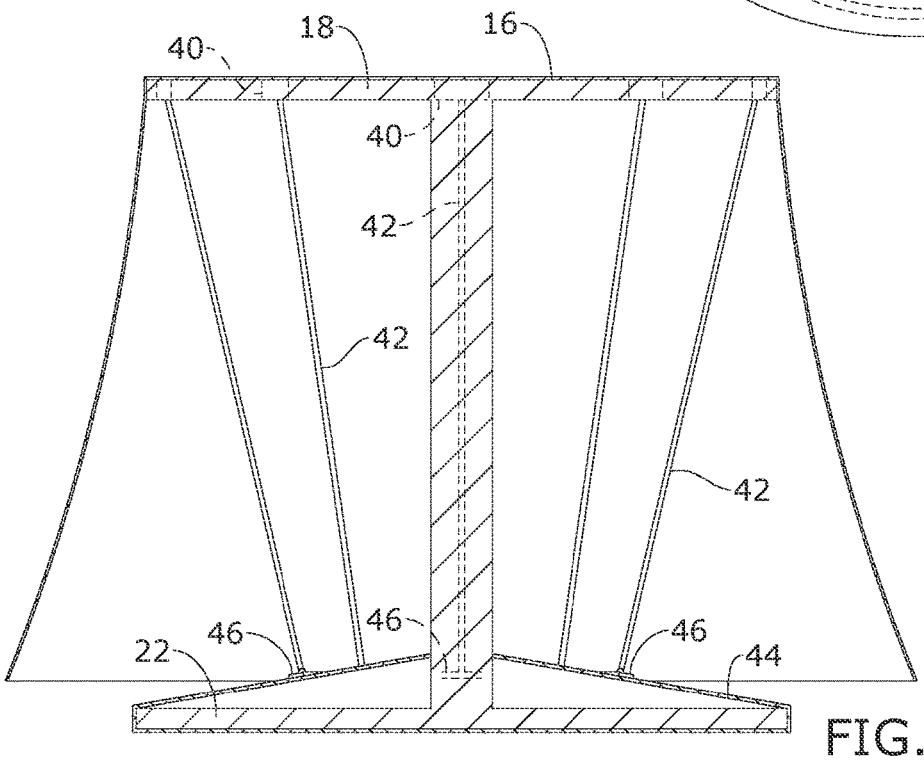
FIG. 12 is a section view of the embodiment of the present invention, taken along line 12-12 in FIG. 11.

As shown in FIGS. 11 and 12, an alternative means for securing a tablecloth 16 in place may also be provided as part of the kit. Rather than using the tubular tabs 10 or ring tabs 24 as previously described, connecting tabs 40 may be provided on an undersurface of a tablecloth 16. These connecting tabs 40 are each connected to a connecting drawstring 42, which couple to an alternative base cover 44 via a connecting base cover tab 46. The alternate base cover 44, in certain embodiments, may be similar in functionality as the base cover 28 previously described. Thus, the tablecloth 16 may be retained securely in place due to its connection to the alternate base cover 44. This connection may be achieved in various ways, in accordance with the present invention. For example, the drawstring 42 may go through one tab 40 on the underside of the cloth 16 and then continue down through a ring on the base cover 44 and pulled until the string 42 is tight and then tied together. It may only take two strings 42 and two tabs 40 and rings tied together to secure the cloth and is up to the user. The best illustration is FIG. 11 which shows the cloth with the natural silhouette as opposed to FIG. 7 which shows an hourglass silhouette. In the hourglass silhouette illustration, the table base covers 44 would only be used to hide the table legs/base 22 if the bottom of the cloth 16 is blown in the wind.

Figure 13:
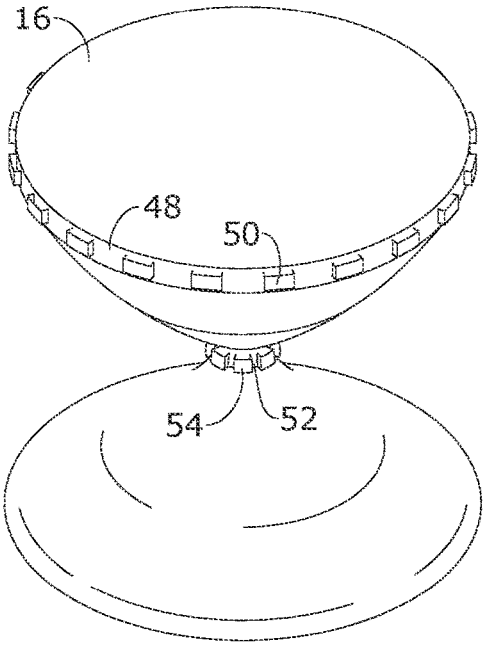
FIG. 13 is a perspective view of the embodiment of the present invention, showing light holder pockets connected to the tablecloth.

FIG. 13 illustrates another aspect of the present invention, which is to provide light at table in an elegant and functional fashion. Upper light holder pockets 50 (which may be transparent) may be provided on an upper light holder ring 48 or directly coupled to the tablecloth 16 (such as via hook and loop fasteners). The pockets 50 are configured such that lights, such as light emitting diode (LED) lights, may be retained in the pockets 50, which provides a unique ambiance as well as solving the problem of lighting when an event is being held outdoors and there is poor lighting (such as at night). As further shown in FIG. 13, a lower light holder ring 52 may retain lower light holder pockets 54 in a similar manner as the upper light holder pockets 50. This lower light configuration may be made possible by utilizing the tabs 10, 24, as previously described, to pull the tablecloth 16 close to the table post 20 so that the lower lights are securely mounted.

Figure 14:
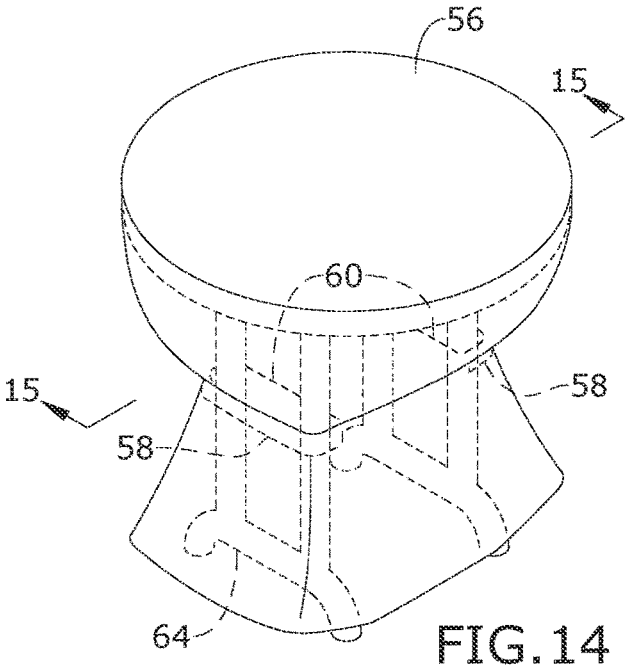
FIG. 14 is a perspective view of a modified version of the embodiment of the present invention, showing attachment of the tablecloth to a table with a plurality of legs.
Figure 15:
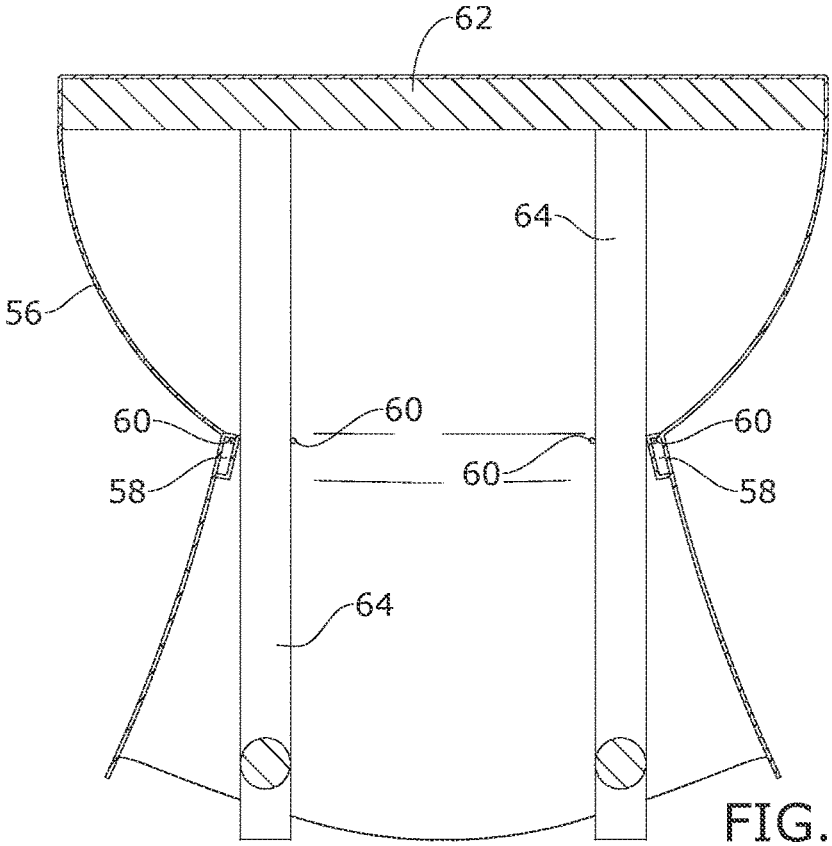
FIG. 15 is a section view of the modified version of the embodiment of the present invention, taken along line 15-15 in FIG. 14.

Referring now to FIGS. 14 and 15, another tablecloth securing configuration, as part of the kit, is shown. As shown, a table may have a plurality of legs 64, such as two. As with the other configurations in the foregoing disclosure, a tablecloth 56 sits on top of a tabletop 62 and drapes down over the edges of the tabletop 62. While the previously described tabs may be used for multi-leg tables as well, it is also preferable to have more diverse securing options, such as what is shown in FIGS. 14-15. A plurality of drawstring conduits 58 (such as two, as illustrated) may be provided on a bottom side of the tablecloth 62, with a respective drawstring 60 extending through each conduit 58 and forming a loop around each respective table leg 64. As with the other configurations described, once each drawstring 60 has been looped around each table leg 64, they may be tied to secure the tablecloth 56 securely in place. As shown, these conduits 58 may each be defined by one or more tabs which have been previously described.

While the tablecloth and tabletop in the previously described embodiments are shown to be circular, it will be appreciated by those with skill in the art that they may be round, rectangular, square or any number of shapes. Embodiments of the present invention may be provided on various sized and shaped tables. The tabs and pockets of the present invention may be attached using various means, such as by ironing or stitching. As mentioned, all the aforementioned structure (i.e., tabs, drawstrings, base covers and sleeves, pockets for lights, light holder ring, and conduits, in certain embodiments, may be provided as part of a table kit (e.g., a container that retains various components described herein) that may be used at events to improve the look and functionality of tables being used. In other embodiments, only some of the aforementioned structure may be provided as part of the kit. For example, tubular tabs 10 might be excluded from a kit that includes ring tabs 24, and vice versa, or the table base covers 28 may be omitted from the kit. In even further embodiments, the components of the present invention described herein may be provided individually, as they all have separate and advantageous functionality as stand-alone products. Additionally, in certain embodiments, these components may be provided as integral with a tablecloth; however, by providing embodiments of the present invention as being connectable to a tablecloth a user is planning on using, the embodiments can readily be applied to many differently sized and shaped tablecloths.

While methods of making the present invention would be readily apparent to those with skill in the art from the foregoing disclosure, a further exemplary method may include the following. The tabs may be formed from fabric, cut to size, and further formed with drawstring rings/sleeves for a drawstring to pass through. A drawstring, which may be cloth cord or other appropriate material, may be provided as a long length that can be cut to size at the location it is to be used. Multiple drawstrings may be provided as part of the kit. The base covers may be formed from fabric (as a "one size fits all" size) and provided with a conduit around its periphery for a drawstring to extend through. The light holder pockets may be formed from a transparent material and shaped to define a cavity that receives a light, such as an LED. In instances where the tablecloth includes attached tabs, a user would specify a size of tablecloth needs (as well as dimensions of the table(s) it is being used on), so that the tabs may be positioned accordingly during manufacturing to provide a wind-resistant effect and define the silhouette the user desires.

A method of using the present invention may include the following. Attach (such as via ironing or sewing) the tabs to a bottom side of a tablecloth, with the placement of the tabs being selected to define a particular silhouette of the tablecloth. Place the tablecloth over a table. Lift the tablecloth to access the tie/drawstring underneath and pull the tie to gather the tie ends together around the table leg(s). The same method may be used for the base covers except the base covers are placed on the floor/ground and the table base or leg is placed on top of it. Pull the tie ends, gather the fabric, and tie the ends of the string together. The base sleeve may be merely slid over the table leg and secured by ties or elastic.

It should be understood, of course, that the foregoing relates to exemplary embodiments of the invention and that modifications may be made without departing from the spirit and scope of the invention as set forth in the following claims.

What is claimed is:

1. A table system comprising:

a first tablecloth defining an upper surface and a lower surface;

a first table comprising a first tabletop, at least one first leg, and a first table base; and a table kit comprising:

a plurality of first tabs, with each first tab defining a conduit, and each first tab being coupled to the lower surface of the first tablecloth; and a first drawstring extending through each of the plurality of first tabs and having ends, wherein the plurality of first tabs are gathered towards the at least one first leg by tension applied to the first drawstring, and the ends of the first drawstring are tied together to secure the first tablecloth to the first table;

wherein the table system further comprises:

a second tablecloth defining an upper surface and a lower surface;

a second table comprising a second tabletop, at least one second leg, and a second table base connected to the at least one second leg, and the table kit further comprising:

a plurality of second tabs, with each second tab being coupled to the lower surface of the second tablecloth;

a base cover that covers at least a portion of the second table base; and a plurality of second drawstrings, with a first end of each second drawstring being coupled to a respective second tab and a second end of each second drawstring being coupled to the base cover to secure the second tablecloth to the second tabletop.

2. The table system of claim 1, wherein each conduit is defined by a tubular drawstring sleeve.

3. The table system of claim 1, wherein each conduit is defined by a drawstring ring.

4. The table system of claim 1, wherein the table kit further comprises a second base cover that is formed from a sheet of fabric and covers at least a portion of the first table base.

5. The table system of claim 1, wherein the plurality of tabs are coupled to the tablecloths via ironing or stitching.

6. The table system of claim 1, further comprising:

a third tablecloth defining an upper surface and a lower surface;

a third table comprising a third tabletop, at least one third leg, and a third table base, and the table kit further comprising:

a plurality of third tabs, with each third tab defining a second conduit, and each third tab being coupled to the lower surface of the third tablecloth; and a third drawstring extending through each of the plurality of third tabs and having ends, wherein the plurality of third tabs are gathered towards the at least one third leg by tension applied to the third drawstring, and the ends of the third drawstring are tied together to secure the third tablecloth to the third table.

7. The table system of claim 1, wherein the table kit further comprises a plurality of transparent pockets that are coupled to each tablecloth, and each transparent pocket is configured to receive a light.

8. The table system of claim 7, wherein the plurality of transparent pockets are disposed along a perimeter of each tabletop.

9. A table system comprising:

a tablecloth defining an upper surface and a lower surface;

a table comprising a tabletop, at least one leg, and a table base connected to the at least one leg; and a table kit comprising:

a plurality of tabs, with each tab being coupled to the lower surface of the tablecloth;

a base cover that covers at least a portion of the table base; and a plurality of drawstrings, with a first end of each drawstring being coupled to a respective tab and a second end of each drawstring being coupled to the base cover to secure the tablecloth to the tabletop.

* * * * *